US005747723A

United States Patent [19]

Buckalew et al.

[11] Patent Number: 5,747,723

[45] Date of Patent: May 5, 1998

[54] MODULAR ARTILLERY CHARGE SYSTEM

[75] Inventors: Gregory Buckalew, Budd Lake; Lydia Chang, MOrris Plains, both of N.J.; Richard Cirincione, East Stroudsburg, Pa.; Robert Garufi, Fairfield, N.J.; Warren Graham, Landing, N.J.; Philip Hui, Parsippany, N.J.; James Rutkowski, Hackettstown, N.J.; Scott Westley, Flanders, N.J.

[73] Assignee: The United States of America as represented by the Secretary of the Army, Washington, D.C.

[21] Appl. No.: 756,863

[22] Filed: Nov. 26, 1996

Related U.S. Application Data

[60] Provisional application No. 60/024,392, Jun. 28, 1996.

[51] Int. Cl.[6] ..... F42B 5/00

[52] U.S. Cl. ..... 102/282; 102/331; 102/431; 102/435; 102/530; 102/700; 102/704

[58] Field of Search ..... 102/202, 282, 102/317, 318, 322, 331, 431–433, 435, 470, 530, 531, 700, 704

[56] References Cited

U.S. PATENT DOCUMENTS

| | | | |
|---|---|---|---|
| 3,176,617 | 4/1965 | Brafford | 102/282 |
| 4,363,273 | 12/1982 | Luebben et al. | 102/431 |
| 4,572,076 | 2/1986 | Politzer et al. | 102/431 |
| 4,702,167 | 10/1987 | Reinelt et al. | 102/282 |
| 5,052,304 | 10/1991 | Rahnenführer et al. | 102/435 |
| 5,151,557 | 9/1992 | Bracuti et al. | 102/435 |
| 5,218,166 | 6/1993 | Schumacher | 102/431 |
| 5,269,224 | 12/1993 | Gonzales et al. | 102/431 |
| 5,454,323 | 10/1995 | Conil | 102/282 |
| 5,463,956 | 11/1995 | Harting | 102/282 |
| 5,565,643 | 10/1996 | Raines et al. | 102/435 |
| 5,672,842 | 9/1997 | Brion et al. | 102/282 |

FOREIGN PATENT DOCUMENTS

| | | | |
|---|---|---|---|
| 2160625 | 12/1985 | United Kingdom | 102/202 |
| 2259753 | 3/1993 | United Kingdom | 102/282 |

*Primary Examiner*—Harold J. Tudor
*Attorney, Agent, or Firm*—John Moran; Michael Sachs

[57] ABSTRACT

A modular artillery charge system consists of two distinct solid propellant charge modules. Each module consists of a three-piece combustible cartridge case design and bi-directional center core core ignition system. The three-piece combustible cartridge case consists of a combustible case body, having an open end and a end; a cap, having a closed end and an open end; and a center tube. The closed ends of the body and the cap have a hole in the center. The center core tube is positioned longitudinally through the combustible case body, and contacts the closed ends of both the cap and the body. The bi-directional center core ignition system comprises a core igniter bag and two end igniter bags. The core igniter bag occupies the center core tube, and the end igniter bags contact the core igniter bag. The bi-directional center core ignition system may be ignited by percussion primers or a laser ignition system. The first module is used individually or in groups of two. The second module is used in groups of three or more. The modules are not used with one another. The modules are distinguishable by color and by shape, so that the modules may be distinguished even under conditions of complete darkness. Each module has a coating applied to the exterior of the case, and mylar seals over the ends, to provide protection to and from the environment.

18 Claims, 5 Drawing Sheets

MODULAR ARTILLERY CHARGE SYSTEM

The invention described herein may be manufactured, used and licensed by or for the U.S. Government for U.S. Government purpose.

This application is a provisional of 60/024392, filed Jun. 28, 1996.

BACKGROUND OF THE INVENTION

The present invention relates to a modular artillery charge system for use in military cannon artillery systems. More specifically, the invention relates to a two-module system of charges, having a three-piece combustible cartridge case design and a i-directional center core ignition system, and each of which is capable of being fired individually or in series as required.

The cannon artillery systems of the 155 mm family currently fielded by the U.S. Army are used with four separate propelling charges. Problems encountered with use of the current system include the following: only two of the four charges are similar; three of the four are flexible and non-rigid, and therefore cannot be handled by automated equipment; two of the four require disassembly in order to achieve shorter ranges; disassembled charges cannot be reused and must be disposed of; and the igniter of these charges is located on only, one end. In addition, many foreign 155 mm artillery systems are capable of achieving ranges greater than the U.S. Army's current capability of 30 km.

Prior to the development of the present invention, tie U.S. Army pursued the development of a replacement for the current system of propelling charges. This alternative, designated the Unicharge, was a single modular increment charge, where each Unicharge increment was identical and therefore interchangeable. Unicharge was designed to be fired in multiples between 1 and 5 for 39 caliber cannons (of which the 155 mm cannon in use by the U.S. Army is an example), and in multiples between 1 and 6 for 52 caliber cannons. Multiples are hereinafter designated "zones", in accordance with military terminology, i.e., a single propelling charge is designated zone 1, two propelling charges in tandem are designated zone 2, and so on.

Problems encountered during development and testing of the Unicharge included the following. First, when firing in zone 1, i.e., multiples of one, the Unicharge exhibited a high probability of "stickers" (an unsafe condition where the projectile does not exit the tube of the artillery cannon). Second, when fired in zone 2, the Unicharge exhibited burning residue (an unsafe condition in which unburned residue in the combustion chamber of the artillery cannon re-ignites upon opening of the breech). And lastly, when firing the Unicharge at top zones (zone 5 for 39 caliber weapons, zone 6 for 52 caliber weapons) at the hot temperature extreme (63° C.) and at maximum stand-off position (wherein all the propelling charges are pushed forward in the cannon combustion chamber in contact with the, base of the projectile), high pressure waves were created. High pressure waves are an unsafe condition wherein localized pressure in the combustion chamber causes pressure waves to reflect between the breech and the base of the projectile, potentially leading to amplified pressures which exceed permissible limits of either the weapon or the projectile, or alternately to premature functioning of the fuse or projectile.

OBJECTS AND SUMMARY OF THE INVENTION

Accordingly, it is an object of the present invention to provide a modular system of propelling charges for use in artillery cannon.

It is a further object of the present invention to provide a system of artillery charges that are capable of being used in multiple zones.

It is a further object of the present invention to provide a system of artillery charges that cart achieve greater distances than the current system.

It is a still further object of the present invention to provide a system of artillery charges that reduces the probability of "stickers".

It is a still further object of the present invention to provide a system of artillery charges that minimizes or eliminates burning residue.

It is a still further object of the present invention to provide a system of artillery charges that does not create pressure waves when firing at top zone.

It is a still further object of the present invention lo provide a system of artillery charges that can be easily handled by automated equipment.

It is a still further object of the present invention to provide a system of artillery charges that has a bi-directional ignition system.

Briefly stated, a modular artillery charge system consists of two distinct solid propellant charge modules. Each module consists of a three-piece combustible cartridge case design and a bi-directional center core ignition system. The three-piece combustible cartridge case consists of a combustible case body, having an open end and a end; a cap, having a closed end and an open end; and a center tube. The closed ends of the body and the cap have a hole in the center. The center core tube is positioned longitudinally through the Combustible case body, and contacts the closed ends of both the cap and the body. The bi-directional center core ignition system comprises a core igniter bag and two end igniter bags. The core igniter bag occupies the center core tube, and the end igniter bags contact the core igniter bag. The bi-directional center core ignition system may be ignited by percussion primers or a laser ignition system. The first module is used individually or in groups of two. The second module is used in groups of three or more. The nodules are not used with one another. The modules are distinguishable by color and by shape, so that the modules may be distinguished even under conditions of complete darkness. Each module has a coating applied to the exterior of the case, and mylar seals over the ends, to provide protection to and from the environment.

According to an embodiment of the invention, there is provided an artillery charge system module comprising a hollow, cylindrical combustible body, having an open end and a closed end with a center hole, the body being substantially rigid; a tube having a first cavity, an first open end, and a second open end; a hollow, cylindrical, combustible cap, having an open end and a closed end with a center hole, the open end of the cap being concentrically attached to the open end of the body; the tube being concentrically positioned in the body to define a second cavity between the body and the tube; each of the first open end and the second open end of the tube being in contact with one of the body and the cap, respectively; an energetic propellant material, placed within the second cavity; a core igniter bag, positioned inside the first cavity; the core igniter bag have two ends; and a pair of end igniter bags, each of the pair of end igniter bags being positioned at one of the ends of the core igniter bag, respectively; and means for attaching each of the pair of end igniter bags to one of the ends of the core igniter bag.

According to an embodiment of the invention, there is provided a modular artillery charge system for propelling projectiles over short and long distances, comprising a first artillery charge system module, and a second artillery charge system module.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
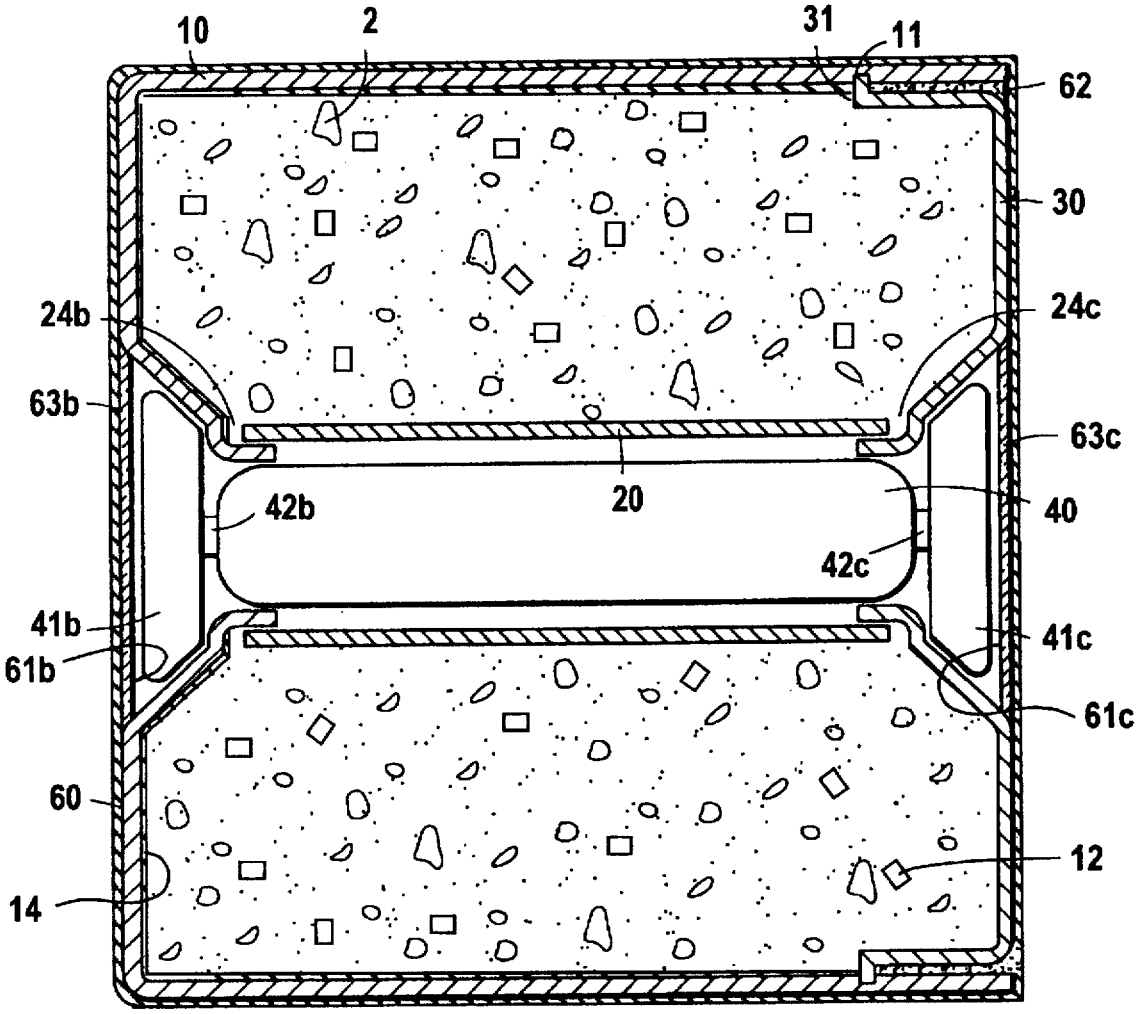
FIG. 1 is a cross-sectional view of an individual propelling charge module.

The present invention, designated Modular Artillery Charge System (MACS), replaces the current system of four different propelling charges with a two-component solid propellant modular system. The first component, designated the XM231, is designed to be fired at zones 1 and 2. The second component, designated the XM232, is designed to be fired at zone 3 and higher. Each charge is comprised of a main charge propellant, a center core igniter and two end igniters, all contained in a combustible cartridge case. The case of the present invention is a three-piece design, consisting of a body, a cap and a center core tube manufactured of a nitrocellulose-based material. A coating applied to the exterior of the case provides protection from water, oil and other hydraulic fluids. A cover placed on each end of the case seals the entire charge.

The modules are similar in external appearance, and share certain critical design features, including:

1. Both charges utilize an identical bi-directional center core ignition system, capable of being ignited via standard primers as well as via laser ignition.
2. Both charges utilize an identical combustible cartridge center core tube.
3. Both charges utilize identical exterior environmental protection means.
4. The exterior diameters of the two modules are within three percent of each other, and the exterior lengths are within five percent of each other, to simplify the load, assembly and pack operations, as well as to simplify the development of an automatic handling system.
5. Both the XM231 and the XM232 are unlinked charges; that is, they are designed so that spaces exist between the charges to permit flamespread around and between the charges.

Because the two charges are not designed to be used with one another, the two charges also have the following critical design feature differences, so that they are identifiable and distinguishable, even in conditions of complete darkness:

1. The XM231 exterior is colored green with a dark color band, for color contrast, around its perimeter, while the XM232 exterior is a different color, in this case brown (green is a color common to U.S. artillery low zone charges).
2. The XM231 weighs approximately 1.93 kilograms, while the XM232 weighs approximately 2.67 kilograms.
3. The XM231 exterior is a straight-walled cylinder, while the XM232 exterior is a straight-walled cylinder with protusions (bumps) on both ends.

The main charge propellant of the XM231 is a single-base formulation. Since the XM231 is fired at low zones, where operating pressures and temperatures are relatively low, it does not contain any additives for flash reduction, wear reduction, or decoppering. The combustible case body and cap of the XM231 have a constant density throughout the parts, and the density is approximately 15% lower than that of the XM232. This ensures burnout of the combustible case at low temperature, low pressure firings. The combustible case body and cap of the XM231 are colored green.

In contrast to the XM231, the XM232 main charge propellant is a triple-base formulation. The XM232 also contains various additives for flash reduction, wear reduction and decoppering. A wax liner, which contains a wear reducing agent and a decoppering agent as well as a trace amount of flash reducer, is placed between the main charge propellant bed and the combustible case wall. Additive pellets, which contain a decoppering agent and a flash reducer, are also added to the main charge propellant bed as a separate entity. Talc, which accomplishes wear reduction, is included in the combustible case formulation. The combustible case is colored brown, and has a plurality of protrusions on the exterior of both the body and the cap. These features provide both sight and touch distinguishing features from the XM231.

MACS is compatible with all 155 mm artillery systems. MACS also reduces container handling and is compatible with automatic handling systems. MACS requires no nest or special equipment or skills to handle the charges. MACS reduces health hazards associated with propellant charges; noise levels are lower than the currently fielded charges, and it does not use the known toxin lead as a decoppering agent. Finally, MACS is the most insensitive artillery charge system developed to date, minimizing the risk of accidental discharge.

While this MACS is designed as a system of unlinked charges, it will be appreciated that the same basic concept of a modular charge system can be extended as well to linked charges, if desired. Such a system would require incorporation of linking features to guide and hold the charges together, as well as to not exclude linking if adjacent charges are in an incorrect orientation relative to one another.

Referring now to FIG. 1, a propelling charge module 1 is comprised of a body 10, a center core tube 20, and a cap 30. Body 10 and cap 30 each comprise a thin-walled hollow cylinder having an open end and a closed end. Cap 30 fits into and covers the open end of body 10. The closed ends of both cap 30 and body 10 have center holes. Center core tube 20 is positioned longitudinally in body 10, and contacts both cap 30 and the closed end of body 10 in assembled propelling charge module 1. The cavity formed by assembly of propelling charge module 1 is filled with an energetic material 2. All exterior surfaces of body 10 and cap 30 are coated with an environmental protection material 60. Body 10 and cap 30 each have a wall thickness between 2.0 mm–2.7 mm. The dimensions and density of body 10, center core tube 20, and cap 30 are critical to ensure durability, critical functioning of the igniter, and complete combustion. Where values for dimensions and density are given, it is understood by those in the art that these values refer to a 155 mm artillery system, and that these parameters must be adjusted accordingly for other artillery systems.

Figure 2:
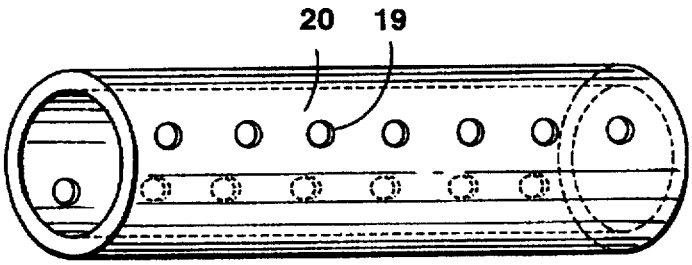
FIG. 2 is a perspective view of an individual center core tube.

Referring now to FIG. 2, center core tube 20 is a thin-walled cylinder with two open ends. Center core tube 20 preferably has a wall thickness of 1.3–1.8 mm, and an inside diameter of 17.7 mm–31.8 mm. This diameter of center core tube 20 is a result of numerous interior ballistic evaluations designed to accomplish a smooth, repeatable ignition. Center core tube 20 can have a multitude of radial holes 19. Center core tube 20 holds a core igniter bag 40. Core igniter bag 40 contacts two end igniter bags **41*b* and 41*c*. End igniter bag 41*b* occupies the center hole in the closed end of body 10, and end igniter bag 41*c* occupies the center hole in cap 30. End igniter bags 41*b* and 41*c* are held in place by attaching means 42*b* and 42*c***, respectively.

Figure 3:
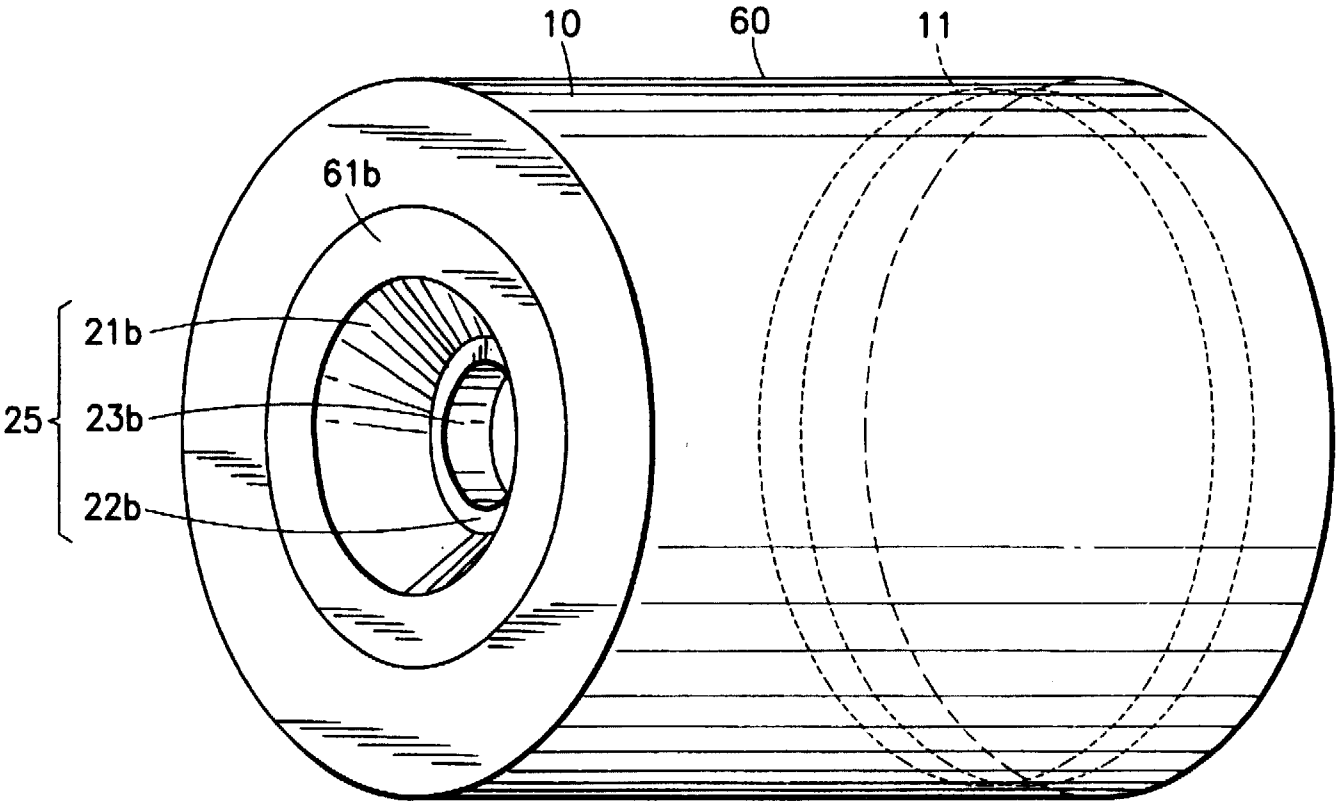
FIG. 3 is a perspective view of an individual combustible cartridge body.

Referring now to FIG. 3, the closed end of body 10 incorporates a center core ignition interface 25, comprising a first surface **21*b*, a second surface 22*b*, and a third surface 23*b*. Center core ignition interface 25 is concentric to body 10, and focuses the ignition from end igniter bag 41*b* (not shown) to core igniter bag 40 (not shown). First surface 21*b* is countersunk, or conically tapered, from the closed end of body 10 to second surface 22*b*. Second surface 22*b* and third surface 23*b* form a counterbore. Second surface 22*b* is a flat area, parallel to the closed end of body 10. Third surface 23*b* is a longitudinal cylinder that interfaces with center core tube 20. Center core ignition interface 25 is covered by an environmental protection interface 61*b***.

Figure 4:
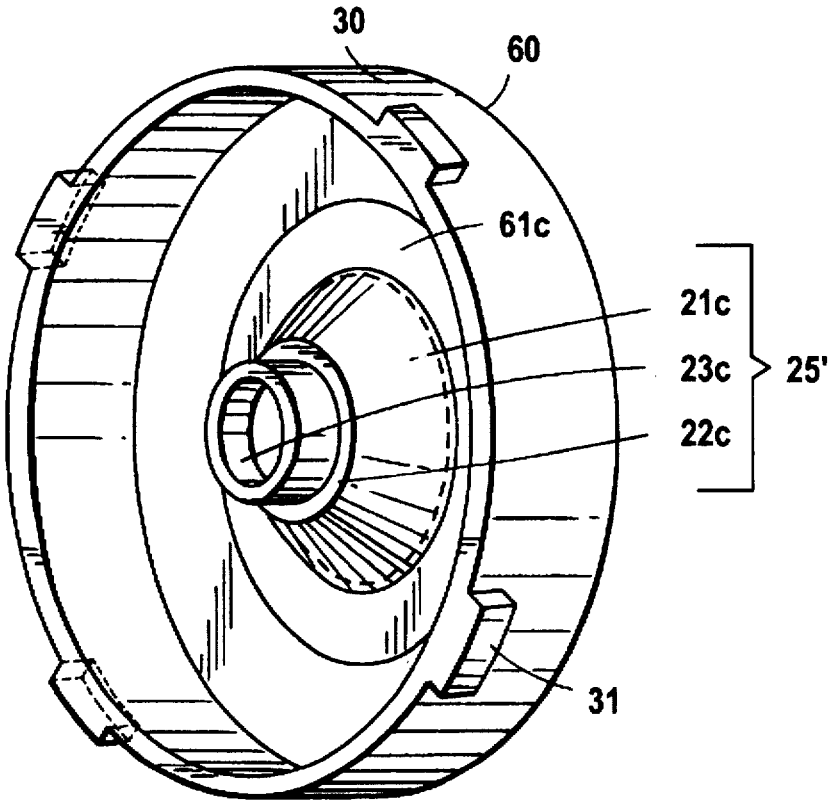
FIG. 4 is a perspective view of an individual combustible cartridge cap.

Referring now to FIG. 4, the closed end of cap 30 incorporates a center core ignition system 25', which is substantially identical to that of the closed end of body 10. Center core, ignition system 25' also comprises a first surface **21*c*, a second surface 22*c*, and a third surface 23*c*. Center core ignition interface 25' is concentric to cap 30, and focuses the ignition from end igniter bag 41*c* (not shown) to core igniter bag 40 (not shown). First surface 21*c* is countersunk, or conically tapered, from the closed end of body 10 to second surface 22*c*. Second surface 22*c* and third surface 23*c* are counterbore, or straight depth. Second surface 22*c* is a flat area, parallel to the closed end of cap 30. Third surface 23*c* is a longitudinal cylinder that interfaces with center core tube 20. Center core ignition interface 25' is covered by ail environmental protection interface 61*c***.

Figure 5A:
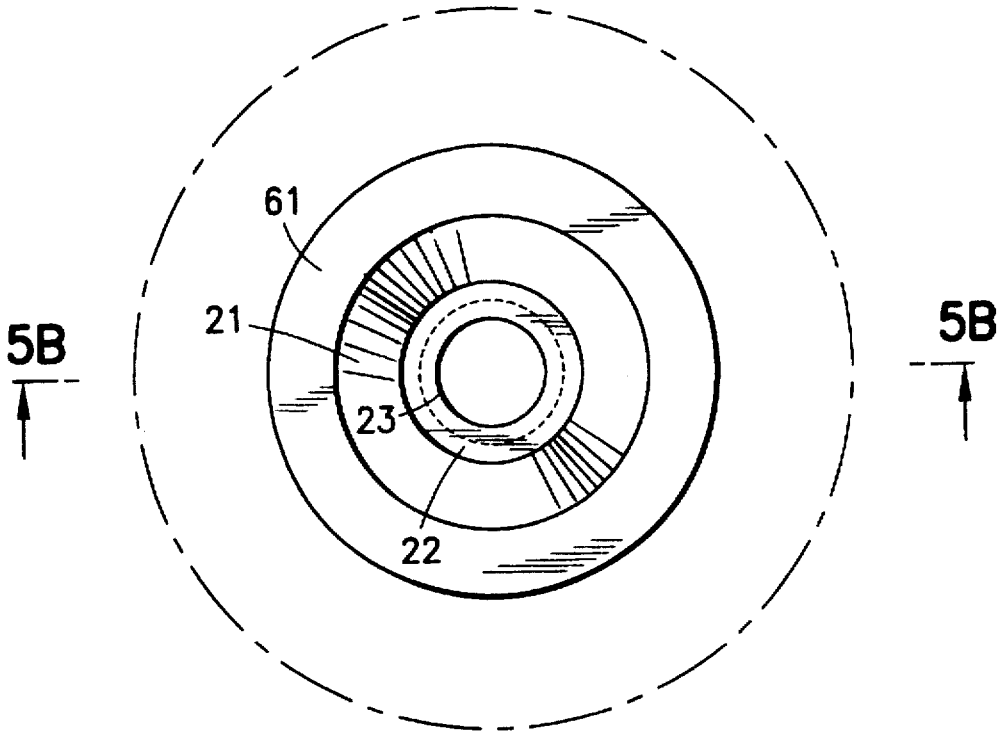
FIGS. 5A and 5B are a top and cross-sectional view of the center core igniter interface which is molded into both the combustible cartridge body and cap.
Figure 5B:
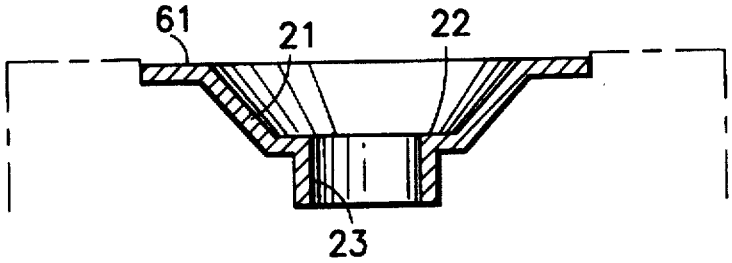

Referring now to FIGS. 5A and 5B, a cross-section of the shape of center core ignition interfaces 25 and 25' is shown. An environmental protection interface 61, comprising a recessed ring-shaped surface, is formed concentric to the center hole. A conically tapered first surface 21 extends from environmental protection interface 61 to a second surface 22. Second surface 22 is a flat area, parallel to the closed ends of body 10 and cap 30, and third surface 23 is a cylinder that interfaces with center core tube 20. Second surface 22 forms a counterbore with third surface 23. First surface 21, second surface 22, and third surface 23 all are concentric to the center hole.

The inside diameter of center core tube 20 is larger than the outside diameter of car third surface **23*c* or body third surface 23*b*, so that one end of center core tube. 20 fits over cap third surface 23*c* and the other end of center core tube 20 fits over body third surface 23*b*. Joints 24*b* and 24*c* (FIG. 1), where center core tube 20 connects to body third surface 23*b* and cap third surface 23*c***, respectively, cart be filled with adhesive or another bonding agent.

Referring now to FIGS. 1 and 3, the open end of body 10 incorporates a groove 11 along the circumference of the interior surface of body 10. The open end of cap 30 incorporates a set of protrusions 31, which fit into groove 11. Protrusions 31 are disposed equally about the periphery of the open end of cap 30, and extend radially from the exterior surface. When cap 30 is inserted into body 10, protrusions 31 mechanically lock into groove 11 of body 10, so that removal of cap 30 requires significant force.

Referring; again to FIG. 1, in addition to environmental protection material 60 covering cap 30 and body 10, the closed end of body 10 and the closed end of cap 30 incorporate environmental protection interfaces **61*b* and 61*c*, respectively. Environmental protection interfaces 61*b* and 61*c* have a slight depth, to accommodate mylar end seals 63*b* and 63*c*, respectively. Mylar end seals 63*b* and 63*c* are placed over end igniter bags 41*b* and 41*c*, respectively. Mylar end seals 63*b* and 63*c* are thin, transparent, and waterproof. A final environmental seal is provided by an adhesive or other bonding agent placed in a channel 62 between the end surface; of the open end of body 10 and the exterior surface of the closed end of cap 30**.

Core igniter bag 40 is filled with any suitable igniter material, such as, for example, either nitrocellulose and 22%–28% nitroglycerin, or a black powder-type material. End igniter bags **41*b* and 41*c* are filled with a loose load of any suitable igniter material, such as, for example, a black powder-type material. It is advantageous to use nitrocellulose and 22%–28% nitroglycerin or a black powder-type material for core igniter bag 40, and a black powder-type material for end igniter bags 41*b* and 41*c***, to accomplish uniform ignition via either percussion primers or laser ignition.

Energetic material 2 for the XM231 consist of any suitable main charge propellant. It was found to be advantageous to use a single-base formulation that substantially comprises nitrocellulose. Body 10 and cap 30 of the XM231 have a constant density throughout the parts. This density is approximately 15% lower than that of the XM232. Together, the density of body 10 and cap 30 of the XM231 and the formulation of the main charge propellant ensure complete burnout at low temperature, low pressure firings.

Energetic material 2 for the XM232 consist of a suitable main charge propellant and various additives. It was found advantageous to use a main charge propellant comprising a triple-base formulation that includes nitrocellulose, nitroglycerin and nitroguanidine. Additives can include a wax liner, which is placed on the interior of body 10; additive pellet 12, which are included as a separate item with energetic material 2; and a wear reduction agent included in the formulation of body 10 and cap 30. The wax liner 14 includes bismuth-containing compounds, to accomplish decoppering, and/or titanium-containing compounds, to accomplish wear reduction. The additive pellets include bismuth-containing compounds, for decoppering, and potassium-containing compounds, for flash reduction. Talc can be included in the formulation of body 10 and cap 30 as the wear reduction agent.

Figure 6A:
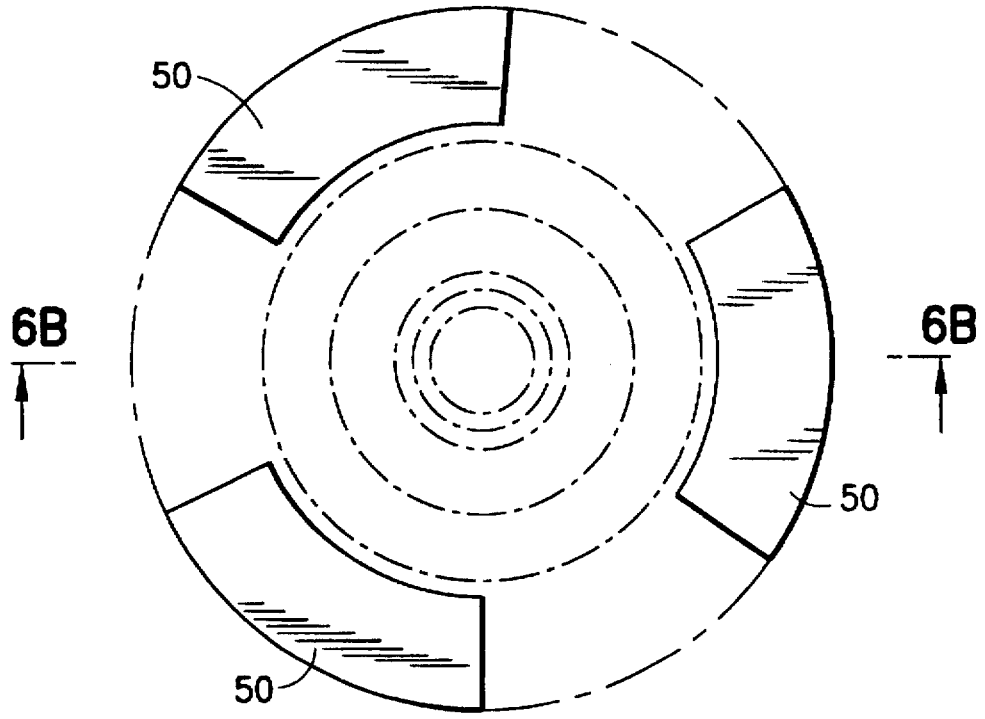
FIGS. 6A and 6B are a top and cross-sectional view of the ignition enhancement protrusions, which are molded into both the body and cap.
Figure 6B:
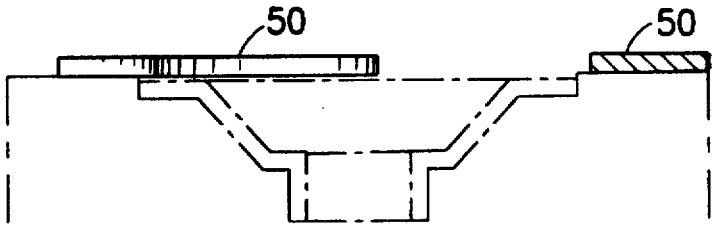

Referring now to FIGS. 6A and 6B, enhancement of ignition for the XM232 module is accomplished by a multitude of ignition enhancement protrusions 50, extending from the closed end surfaces of both body 10 and cap 30. Ignition enhancement protrusions 50 total at least 51% of the total circumference of body 10 and cap 30, so that ignition enhancement protrusions 50 extending from a first propelling charge module 1 can not interlock with ignition enhancement protrusions 50 from an adjacent propelling charge module 1. When propelling charge modules 1 are stacked end-to-end, ignition enhancement protrusions 50 from first propelling charge module 1 contact ignition enhancement protrusions 50 from adjacent propelling charge module 1, such that gaps, equal to twice the height of ignition enhancement protrusions 50, are created between each propelling charge module 1. The gaps between propelling charge modules 1 permit flamespread between and around each propelling charge module 1, to ignite adjacent propelling charge module 1, and so on. The height of each ignition enhancement protrusion 50 is nominally 3.2 mm, and there must be two or more ignition enhancement protrusions 50 at each closed end.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An artillery charge system module, comprising:

a hollow, cylindrical combustible body, having an open end and a closed end with a center hole, said body being substantially rigid, said body closed end incorporating a concentrically positioned body center core ignition interface having a conical first surface joined to a flat second surface which connects to a third tubular surface;

a tube having a first cavity, a first open end, and a second open end;

a hollow, cylindrical, combustible cap, having an open end and a closed end with a center hole, said open end of said cap being concentrically attached to said open end of said body, said closed end of said cap having a concentrically disposed cap center core interface therein having a first conical cap surface, a second flat cap surface, and a third tubular cap surface therein;

said tube being concentrically positioned in said body to define a second cavity between said body and said tube;

said first open end of said tube being in contact with said body closed end core interface third tubular surface, and s id second open end of said tube being in contact with said cap closed end core interface third tubular cap surface;

an energetic propellant material, placed within said second cavity;

a core igniter bag, positioned inside said first cavity;

said core igniter bag having a first end and a second end;

a body end igniter bag operatively disposed in said body closed end in juxtaposition with said conical first surface of said body center core ignition interface;

a cap end igniter bag operatively disposed in said cap closed end in juxtaposition with said first conical surface of said cap center core ignition interface;

means for attaching said body end igniter bag to said first end of said core igniter bag; and means for attaching said cap end igniter bag to said second end of said core igniter bag.

2. An artillery charge system module according to claim 1, further comprising a means for sealing said body and said cap together.

3. An artillery charge system module according to claim 2, wherein said means for sealing said body and said cap together comprises:

a groove, being located along a first circumference of an interior surface of said open end of said body; and a plurality of protrusions, being located along a second circumference of an exterior surface of said cap and engaging said groove.

4. An artillery charge system module according to claim 1, further comprising a channel between said body and said cap, said channel being filled with an adhesive.

5. An artillery charge system module according to claim 1, further comprising:

an environmental protection material covering an exterior surface of said body and an exterior surface of said cap; and a pair of waterproof seals, each of said seals being placed over one of said center holes of said closed ends of said body and said cap, respectively.

6. An artillery charge system module according to claim 1, wherein said tube contains a plurality of radial holes along a length of said tube.

7. An artillery charge system module according to claim 1, wherein:

said tube, has a thickness between 1.3 mm and 1.8 mm, and said tube has an inside diameter between 17.7 mm and 31.8 mm.

8. An artillery charge system module according to claim 1, wherein:

said body end igniter bag, said cap end igniter bag and said core igniter bag each contain black powder.

9. An artillery charge system module according to claim 1, wherein:

said body end igniter bag and said cap end igniter bag contain black powder; and said core igniter bag contains nitrocellulose and nitroglycerin, said nitroglycerin being present at between 22 and 28 percent of total weight.

10. An artillery charge system module according to claim 1, wherein:

said body and said cap are substantially composed of nitrocellulose; and said energetic propellant material is substantially composed of nitrocellulose.

11. An artillery charge system module according to claim 1, wherein:

said body and said cap of said module are substantially composed of nitrocellulose; and said energetic propellant material includes a mixture of nitrocellulose, nitroglycerine, and nitroguanidine.

12. An artillery charge system module according to claim 1, further comprising:

a plurality of protrusions;

said protrusions being positioned on said closed end of said body and on said closed end of said cap; and said protrusions total at least 51% of each of a circumference of said closed end of said tube and a circumference of said closed end of said cap.

13. An artillery charge system module according to claim 1, further comprising:

a wax liner covering an interior surface of said module;

said wax liner having at least one of an additive effective to accomplish decoppering and an additive effective to accomplish wear reduction.

14. An artillery charge system module according to claim 13, wherein:

said additive effective to accomplish decoppering includes a bismuth-containing compound; and said additive effective to accomplish wear reduction includes a titanium-containing compound.

15. An artillery charge system module according to claim 1, further comprising:

a plurality of additive pellets in said second cavity;

said additive pellets incorporating a bismuth-containing compound effective to accomplish decoppering; and said additive pellets incorporating a potassium-containing compound effective to accomplish flash reduction.

16. An artillery charge system module according to claim 1, wherein said cap and said body of said module include a talc-containing compound effective to accomplish wear reduction.

17. A modular artillery charge system for propelling projectiles over short and long distances, comprising:

a first artillery charge system module;

a second artillery charge system;

said first and second artillery charge modules each including;

a hollow, cylindrical combustible body, having an open end and a closed end with a center hole, said body being substantially rigid, said body closed end incorporating a concentrically positioned body center core ignition interface having a conical first surface joined to a flat second surface which connects to a third tubular surface;

a tube having a first cavity, a first open end, and a second open end;

a hollow, cylindrical, combustible cap having an open end and a closed end with a center hole, said open end of said cap being concentrically attached to said open end of said body, said closed end of said cap having a concentrically disposed cap center core interface therein having a first conical cap surface, a second flat cap surface which connects to a third tubular cap surface therein;

said tube being concentrically positioned in said body to define a second cavity between said body and said tube;

said first open end of said tube being in contact with said body closed end core interface third tubular surface and said second open end of said tube being in contact with said cap closed end core interface third tubular surface;

an energetic propellant material, placed within said second cavity;

a core igniter bag positioned inside said first cavity;

said core igniter bag having a first and second end;

a body end igniter bag operatively disposed in said body closed end in juxtaposition with said conical first surface of said body center core ignition interface;

a cap end igniter bag operatively disposed in said cap closed end in juxtaposition with said first conical surface of said cap center core ignition interface; and means for attaching said body end igniter bag to said first end of said core igniter bag;

means for attaching said cap end igniter bag to said second end of said core igniter tag; and means for differentiating said first artillery charge system module from said second artillery charge system module.

18. A modular artillery charge system according to claim 17, wherein:

said means for differentiating said first artillery charge system module from said second artillery charge system module includes a plurality of protrusions;

said protrusions being positioned on said closed ends of said body and said cap of said second artillery charge system module; and said protrusions totalling at least 51% of each of a circumference of said closed end of said tube and a circumference of said closed end of said cap.

* * * * *

UNITED STATES PATENT AND TRADEMARK OFFICE

CERTIFICATE OF CORRECTION

PATENT NO. : 5,747,723

DATED : May 5, 1998

INVENTOR(S) : G. Buckalew et al.

It is certified that error appears in the above-identified patent and that said Letters Patent is hereby corrected as shown below:

On the title page, of the patent, in section [75], in the second line there "MOrris" has been changed to --Morris--.

In the Abstract, fourth line down "center core core ignition system" has been changed to --center core ignition system--. In the sixth line down "a" has been changed to --an--.

In column 1, line 6 the words "is a provisional of 60/024,392" have been changed to ---claims priority based upon U.S. provisional application number 60/024,392,---. In line 13, "i-directional" has been changed to --bi-directional---. In line 25, the comma has been deleted after "only". Line 29, "tie" has been changed to ---the---. In line 54, the comma has been deleted after "the".

In column 2, line 5, "cart" has been changed to --can--. In line 27, "a end" has been changed to --an end--. In line 39, "nodules" has been changed to --modules--. In line 50, "an" has been changed to --a--.

In column 5, line 61, "car" has been changed to --cap--. In line 62, the comma after "tube" has been deleted.

In column 6, line 21, the semicolon has been deleted. In line 34, "consist" has been changed to --consists--. In line 49, "pellet" has been changed to --pellets--.

In column 7, (claim 1), in line 44, "s id" has been replaced with --said--.

In column 8, (claim 7), in line 23, the comma has been deleted after "tube"

UNITED STATES PATENT AND TRADEMARK OFFICE

CERTIFICATE OF CORRECTION

PATENT NO. : 5,747,723

DATED : May 5, 1998

INVENTOR(S) : G. Buckalew et al.

It is certified that error appears in the above-identified patent and that said Letters Patent is hereby corrected as shown below:

In column 10, (claim 17), in line 22, "tag" has been changed to --bag--.

Signed and Sealed this

Twenty-third Day of March, 1999

*Attest:*

Q. TODD DICKINSON

*Attesting Officer*

*Acting Commissioner of Patents and Trademarks*